US005634224A

United States Patent [19]

Gates

[11] Patent Number: 5,634,224

[45] Date of Patent: Jun. 3, 1997

[54] INFLATABLE CUSHIONING DEVICE WITH SELF OPENING INTAKE VALVE

[76] Inventor: Stephen M. Gates, 7300 Yonge Street, Apt. 601, Thornhill, Ontario L4J 7Y5, Canada

[21] Appl. No.: 291,551

[22] Filed: Aug. 16, 1994

[51] Int. Cl.[6] ..... A47C 27/10

[52] U.S. Cl. ..... 5/709; 5/710; 5/654

[58] Field of Search ..... 5/450, 453, 455, 5/456, 449, 654, 709, 706, 710, 655.3

[56] References Cited

U.S. PATENT DOCUMENTS

| | | | |
|---|---|---|---|
| 201,728 | 3/1878 | White . | |
| 2,750,606 | 6/1956 | Freedlander et al. | 5/450 |
| 4,477,935 | 10/1984 | Griffin | 5/241 |
| 4,644,597 | 2/1987 | Walker | 5/453 |
| 4,908,895 | 3/1990 | Walker | 5/453 |
| 4,989,283 | 2/1991 | Krouskop | 5/453 |
| 5,020,176 | 6/1991 | Dotson | 5/453 |
| 5,033,133 | 7/1991 | Nissen | 5/450 |
| 5,070,560 | 12/1991 | Wilkinson | 5/241 |
| 5,142,717 | 9/1992 | Everard et al. | 5/450 |

*Primary Examiner*—Alexander Grosz
*Attorney, Agent, or Firm*—Heslin & Rothenberg, P.C.

[57] ABSTRACT

A cushioning device comprising an envelope containing a fluid in which the envelope has a pressure relief valve and an intake valve to regulate the deformation of the envelope under the load and reformation of the envelope when the load is removed.

27 Claims, 7 Drawing Sheets

INFLATABLE CUSHIONING DEVICE WITH SELF OPENING INTAKE VALVE

BACKGROUND OF THE INVENTION

This invention relates to a cushioning device for a mattress, sofa, seat or the like wherein partial support is obtained from a fluid, such as air. In some embodiments, this invention relates to a combination of a resilient member, and an impervious envelope having intake and exhaust valves which make up a deformable and reformable cushion.

In the prior art it is known to use "air-sacks", "bladders" or "air cells", as they have been called, as a support means for a mattress, e.g. U.S. Pat. No. 201,728 granted to White on Mar. 26, 1878 and U.S. Pat. No. 4,477,935 granted to Griffen on Oct. 23, 1984. It is also known to provide a means and method of controlling the amount of inflation in such air cells to support a person at a predetermined height to optimize comfort or support. For example, U.S. Pat. No. 4,989,283 teaches the use of a microprocessor to monitor and to control pressure in a plurality of air cells of a mattress to provide different support characteristics for different positions of a person on the mattress. U.S. Pat. No. 5,070,560 provides a mattress structure in which air cells have a valve for manually inflating or deflating individual air cells to desired pressures to relieve bed sores.

DESCRIPTION OF THE INVENTION

The present invention provides an envelope containing a fluid and has exhaust and intake valves. When a load is applied to the envelope, e.g. by a person resting on it, the fluid exhausts as the envelope conforms to the body shape of a person resting on it but maintains sufficient pressure to support the person on a cushion of fluid. The exhaust valve acts as a pressure relief valve to permit exhaustion of fluid when pressure within the envelope exceeds a predetermined threshold pressure. In some embodiments of the invention, the exhaust valve is adjustable so that it may be preset to different threshold pressures. An intake valve means is provided to refill the envelope. The intake valve is a one way valve that only permits intake of fluid when pressure within the envelope is less than the pressure of fluid supply. Pressure within the envelope will decrease as the load is lifted from it. In a preferred embodiment, a resilient means is provided to reform the envelope after the load is lifted from it.

The weight of a person resting on the envelope deforms the envelope. The fluid pressure within the envelope increases as the volume of the envelope decreases under deformation. Further, as the envelope deforms to conform to the irregular shape of a person, the area of the envelope supporting the load increases. Equilibrium is achieved when the forces within the envelope, including pressure of the fluid within the envelope multiplied by the area of the envelope supporting the load, equal the weight of the load. The provision of a pressure relief valve on the envelope permits gradual deflation of the envelope to facilitate conformation to a person's shape resulting in an increased area of support and a reduced, more comfortable, pressure over the area of support. A controllable pressure relief valve permits one to preset the threshold pressure at which it will retain fluid. Different threshold pressures allow one to accommodate different weights or to allow for different degrees of conformation.

Resilient means may be provided to reform the envelope after removal of the load. Provision of resilient means allows reinflation of the envelope by exerting a reforming force on the walls of the envelope. The resilient means may be provided inside or outside the envelope. In preferred embodiments a resilient foam is provided within the envelope.

A one way intake valve means permits the fluid to re-enter the envelope. A supply reservoir may provide the intake fluid at a suitable pressure. Alternatively, resilient means may used as described above to create a partial vacuum to draw the fluid into the envelope.

Broadly stated, the invention is a cushioning device comprising: a load bearing envelope containing fluid; a fluid supply reservoir; a fluid exhaust reservoir; a relief valve means in communication with said envelope and said fluid exhaust reservoir to release fluid from said envelope to said exhaust reservoir when pressure in the envelope exceeds a predetermined relief pressure; an intake valve means to permit fluid to re-enter the envelope from the supply reservoir when fluid pressure within the envelope is less than pressure in the fluid supply reservoir; combining to permit the envelope to deform under the application of a load to provide a greater area of the envelope to resist the load until the fluid pressure in the envelope reaches said predetermined relief pressure.

It will be appreciated that the intake and supply reservoirs may be combined into one and may be an ambient source of fluid, particularly where the fluid is air.

DESCRIPTION OF THE FIGURES

In the Figures that illustrate preferred embodiments of this invention.

DESCRIPTION OF PREFERRED EMBODIMENTS

Figure 1:
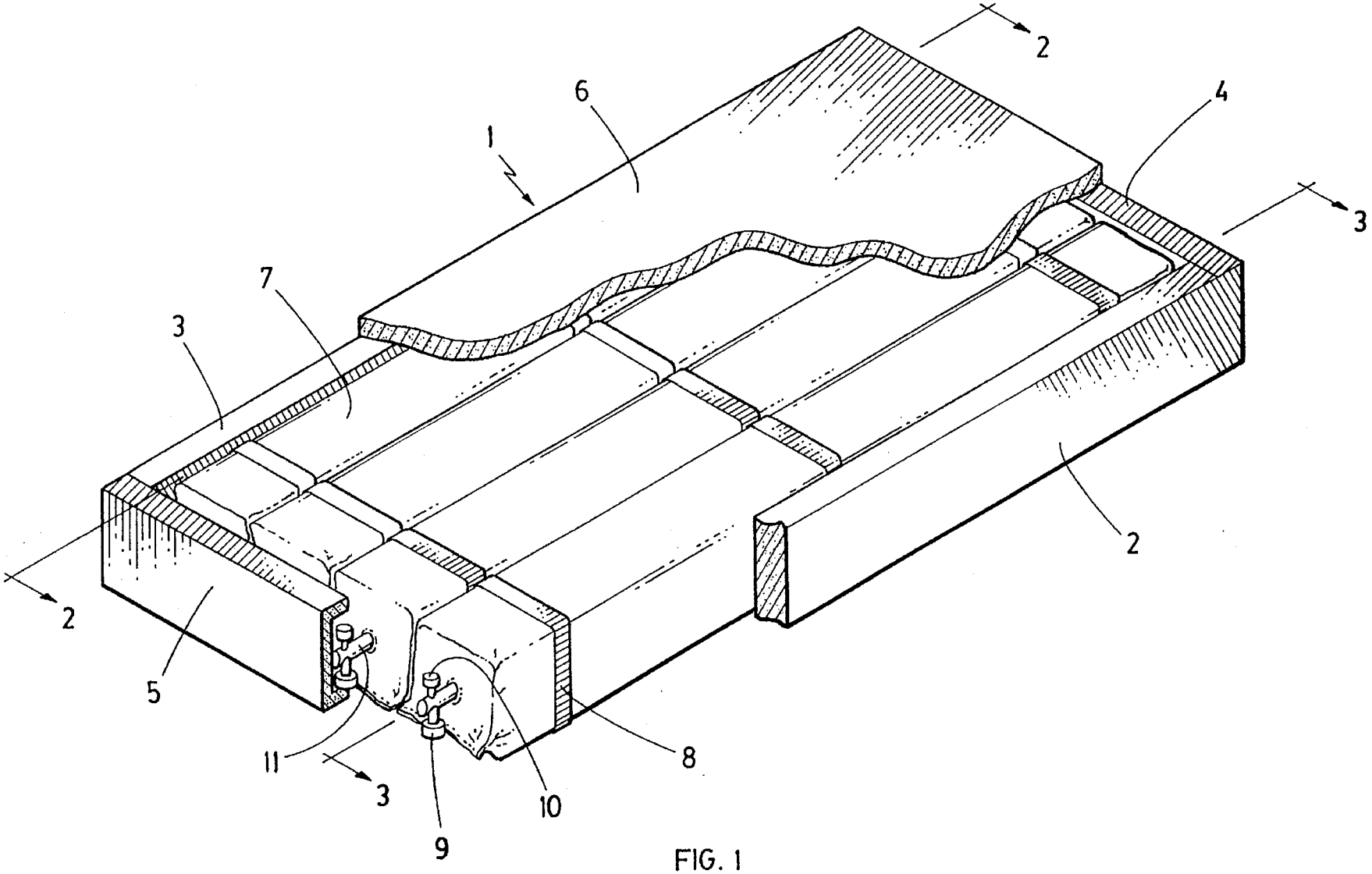
FIG. 1 is a schematic of a mattress having envelopes constructed in accordance with one preferred embodiment of this invention.
Figure 2:
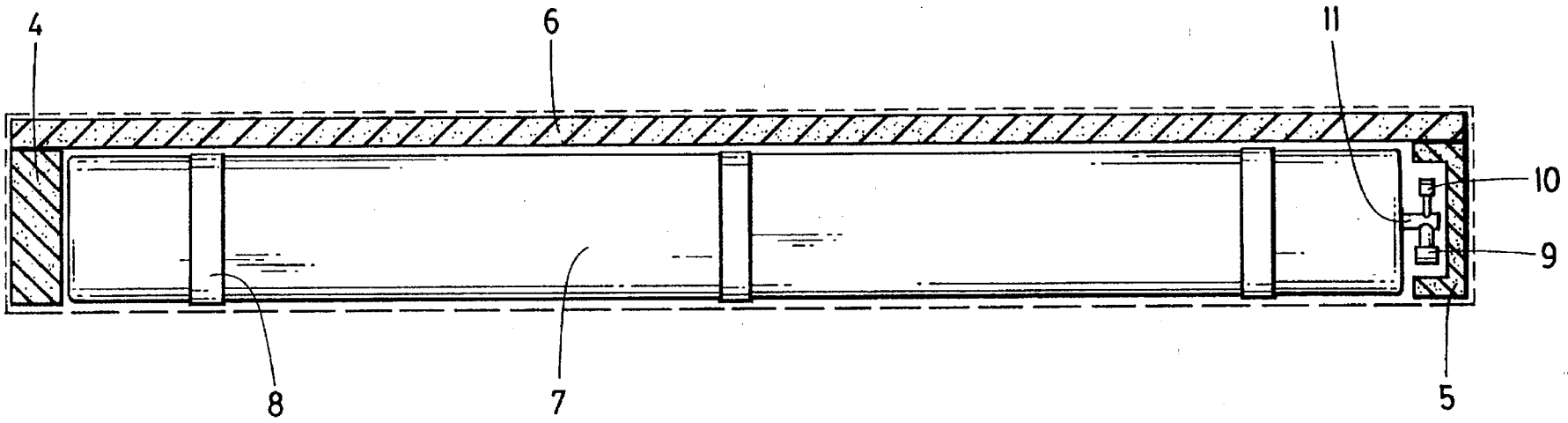
FIG. 2 is a cross-section taken through a side view of said mattress on lines 2—2 in FIG. 1.
Figure 4:
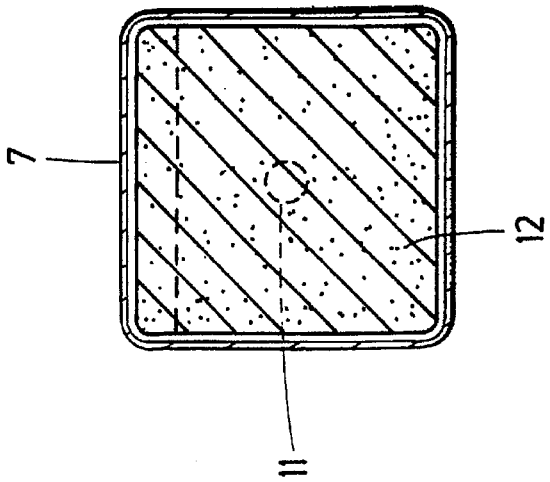
FIG. 4 is an cross-sectional end view of a envelope taken along lines 4—4 in FIG. 3.
Figure 3:
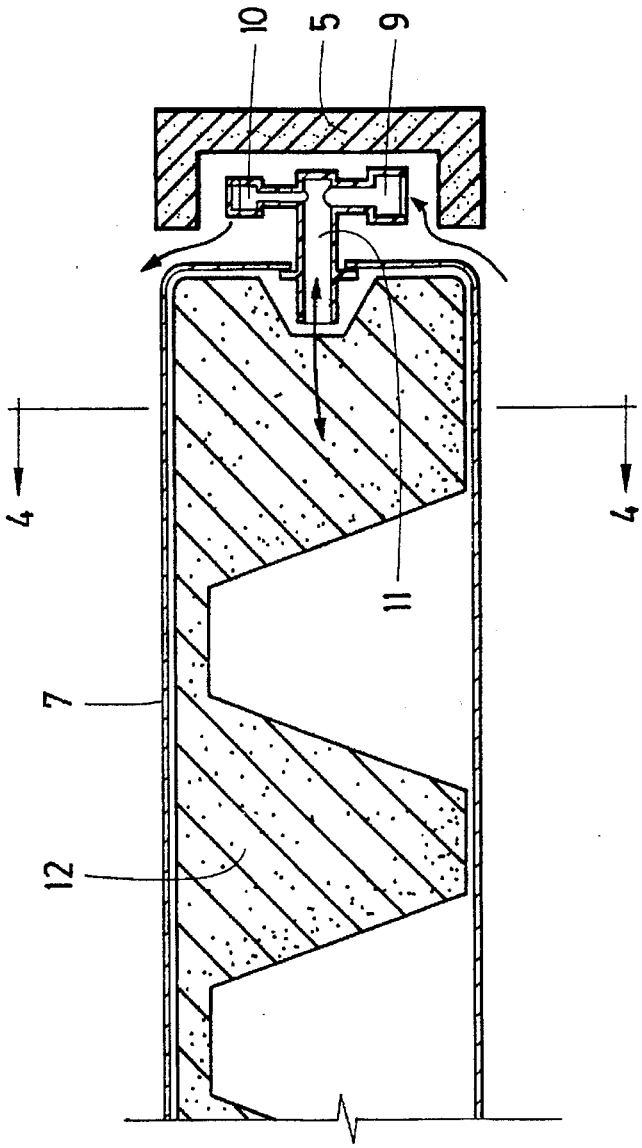
FIG. 3 is a cross-sectional detail of an envelope and the intake and exhaust valves taken along lines 3—3 in FIG. 1.
Figure 5:
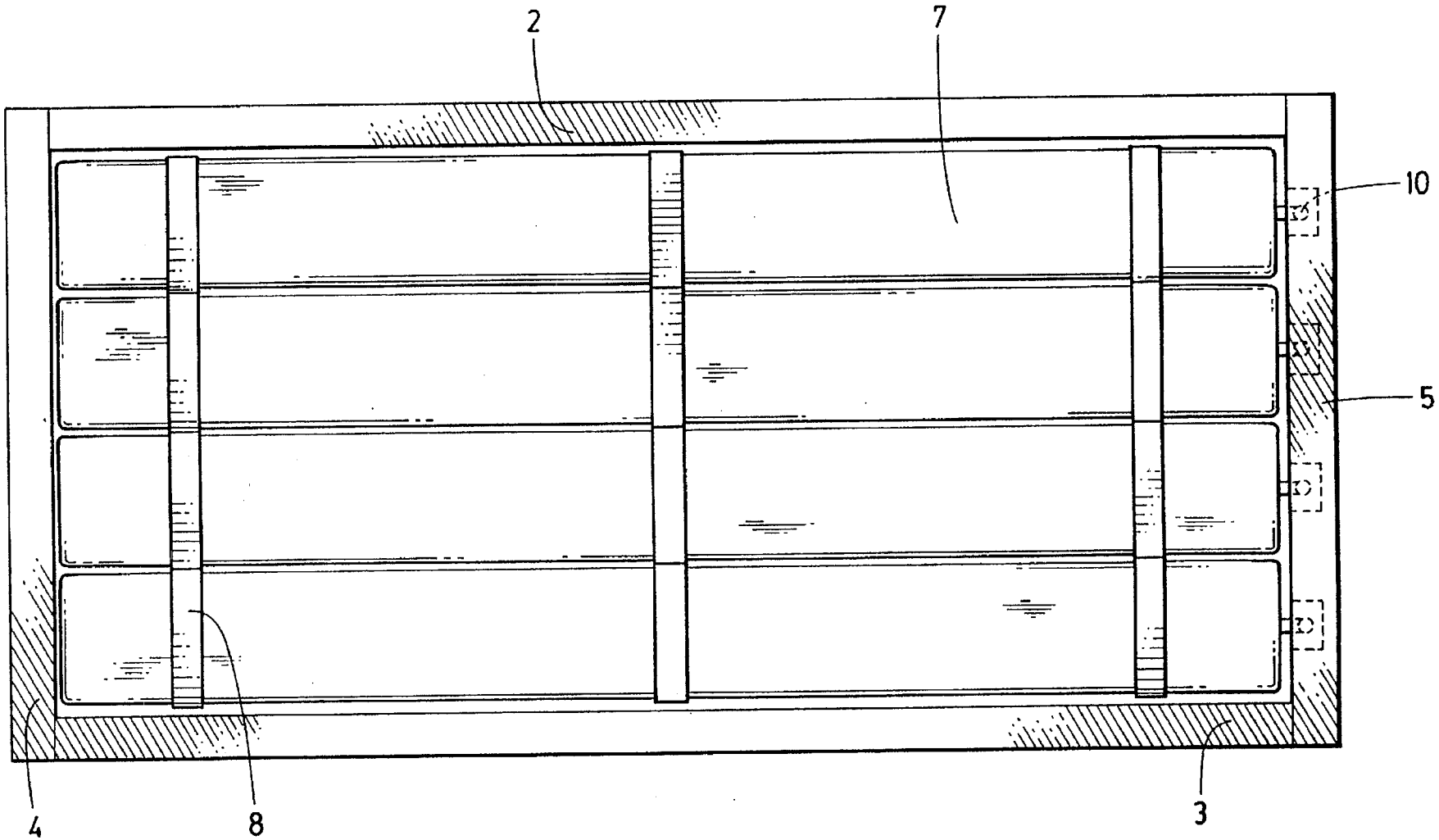
FIG. 5 is a plan view of a mattress having envelopes constructed in accordance with this invention.

Referring to FIGS. 1, 2 and 3, a mattress (1) comprises two side walls (2) and (3) and two end walls (4) and (5), a resilient cover (6) and envelopes (7) connected by bands (8). The particular construction of the mattress (1) shown in FIG. 1 is not essential to this invention but is illustrative of a use of the invention. Each envelope (7) has an intake and exhaust valves (9) and (10) respectively connected to a common pipe (11) in communication with the interior of the envelope (7). Each intake valve (9) may be a simple one way or check valve that permits air or other fluid to flow in one direction, namely into the interior of the envelope (7). Each exhaust valve (10) is a relief valve that permits exhaust to flow from the envelope (7) when pressure within the envelope exceeds the release pressure of the exhaust valve (12). In a preferred embodiment of the invention an exhaust valve (12) has a pressure regulator which permits one to preset the release pressure.

The envelopes of this preferred embodiment contain a resilient substance (12) which is deformable as load is applied but which will spring back to its original shape as the load is removed. As it returns to its original shape, it presses against the interior wall of the envelope to create a partial vacuum to draw fluid into the intake valve (9). The envelope may be loose fitting (see FIG. 3) or snug (see FIG. 6) about the resilient substance (12). In a preferred embodiment the resilient substance (12) is coated with an envelope forming material. It is desirable that the resilient substance (12) should be permeable to the passage of the fluid to facilitate exhaustion and refilling of the envelope. A person skilled in the art having the benefit of this specification will be able to select suitable fabrication materials from a wide array of conventional materials. Examples of such materials, not intended to be limiting, include polyethylene for envelopes, polyurethane foam for resilient material and air for a fluid.

The fluid used in the envelopes is preferably a compressible fluid but could be non-compressible as well. Air is preferred since it can be exhausted into and drawn from the surrounding environment which provides a convenient reservoir. If other fluids are used, it will be appreciated that a reservoir will be required in communication with the intake and exhaust valves. It will also be appreciated that two reservoirs may be provided; one for intake and one for exhaust. If separate intake and exhaust reservoirs are used, each reservoir pressure may be preset to assist in pressure regulation of the envelope (7).

Figure 6:
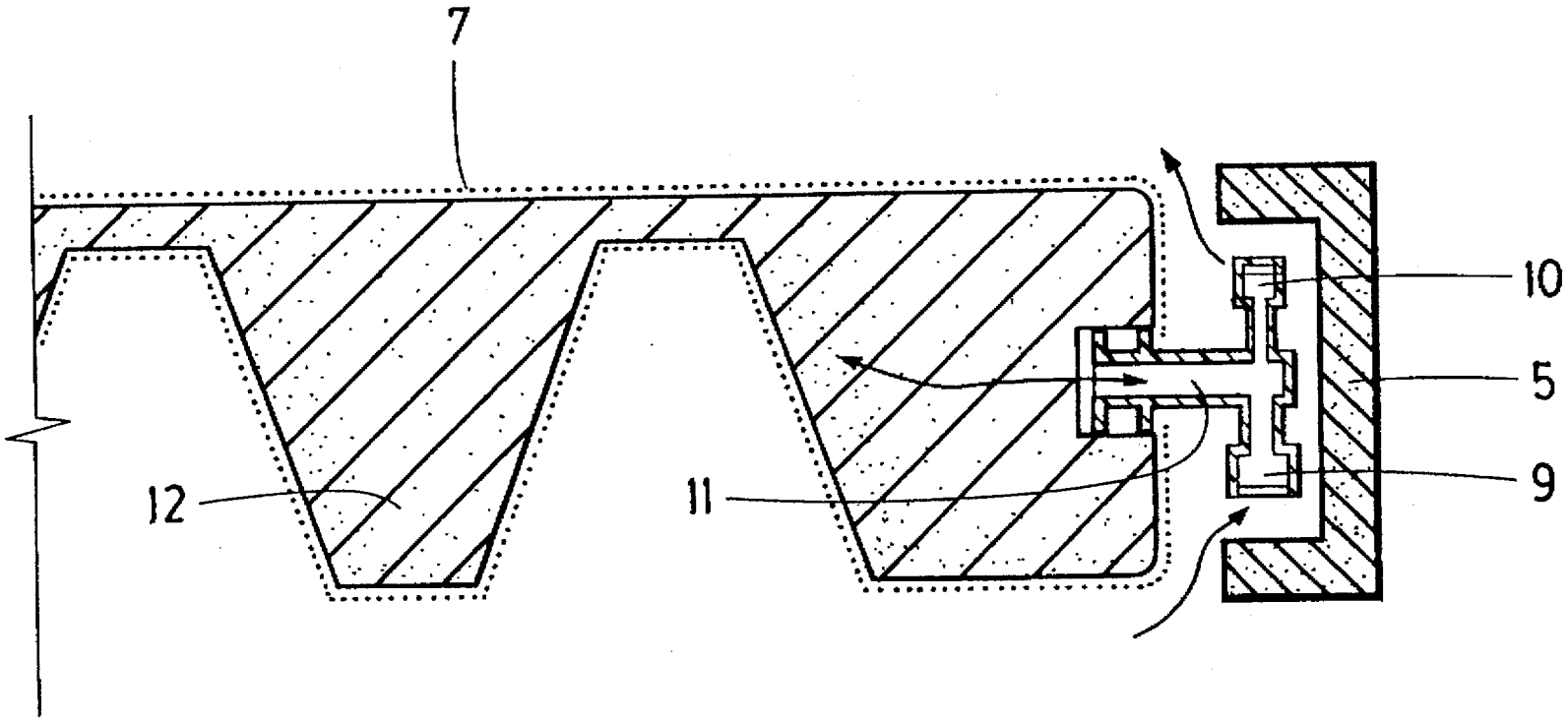
FIG. 6 is a detail of a side view of an envelope constructed in accordance with another preferred embodiment of this invention.

The application of a rounded or convexly curved load to the envelope (7) will result in load area increasing as the load sinks into the envelope (7). However, to augment this effect, the resilient material (12) may be shaped to provide an increasing area to the load as its sinks into the material. Moreover, the resilient material (12) may be shaped to provide more resistance as the load sinks which reduces the amount of the load available to increase fluid pressure in the envelope (7). It is preferred that the resilient material (12) have the shape of a truncated pyramid as shown in FIGS. 3 and 6 for this purpose. It will be appreciated that other shapes, such as cones will also be suitable for this purpose.

In operation, the envelope of this invention will deform under load while exhausting fluid until equilibrium is achieved in the forces of the load, the fluid pressure and the resilient material. Pressure within the envelope (7) is maintained below a release pressure of the exhaust valve (10) and the release pressure is set to allow the load to sink into an envelope (7) by a desired amount. The pressure regulation feature of the exhaust valve permits a release pressure to be preset to accommodate a particular load or a range of anticipated loads.

In the example of a hospital bed (1), such as that shown in FIGS. 1–5, different envelopes (7) may have exhaust valves (10) set at different release pressures. Thus the bed (1) may be adapted to have certain envelopes (7) which will support a patient at a lower level and others at a higher level.

There are many applications for the feature of independent control over the support height of the envelopes. For example, the envelopes (7) may be set with higher levels of support near the sides to resist the tendency of a patient to roll accidentally out of bed or the envelopes (7) may be set to assist a patient to roll over from an existing position to a different position to relieve sores or to present an area for treatment. Active control of intake and exhaust pressures can facilitate more active control of the patient. Other such uses of this invention will become apparent to those skilled in the art.

Figure 7:
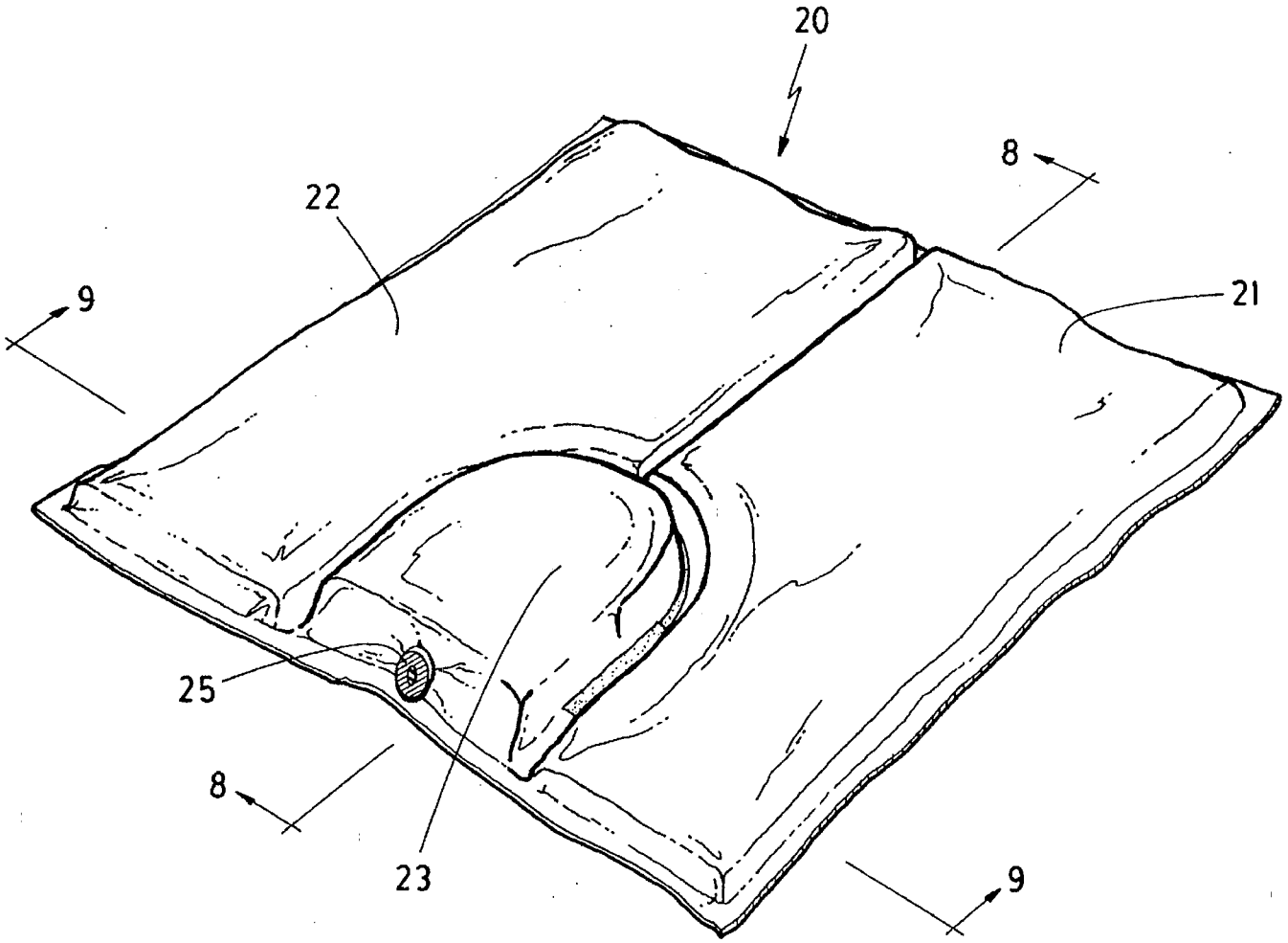
FIG. 7 is a schematic view of a cushion having envelopes constructed in accordance with a third preferred embodiment of this invention.
Figure 8:
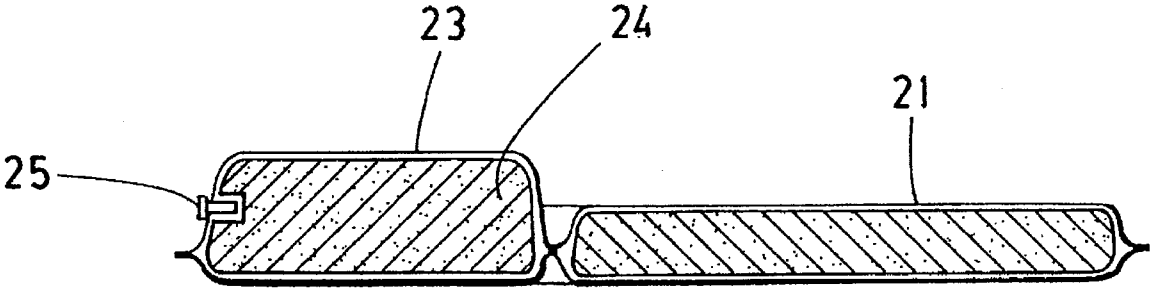
FIG. 8 is a cross-section through a side view of said cushion.
Figure 9:
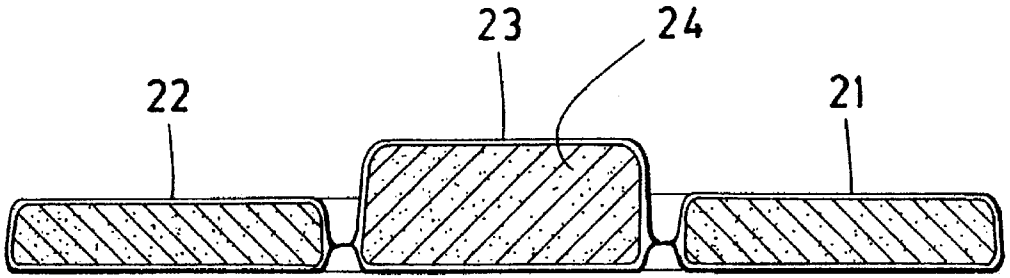
FIG. 9 is a cross-section through an end view of said cushion.

Another embodiment of this invention shown in FIGS. 7–9 illustrates a seat cushion constructed to take advantage of this invention. A cushion (20) is made up of three envelopes (21), (22) and (23) which are filled with a resilient material (24). One or more intake and exhaust valves (25) may be provided depending on the construction desired. Each intake and exhaust valve (25) has the features described above in that it will intake fluid at ambient conditions and exhaust at a predetermined release pressure. The envelopes (21), (22) and (23) may be in communication as shown or form separate chambers having their own valves (25). In the former configuration, the envelopes (21), (22) and (23) will have a common release pressure, therefore resistance to loading in each envelope will depend on the thickness and resilience of the resilient material within them. In the latter configuration, the resistance to loading will also depend on individual pressure settings of a exhaust valve (25) in each envelope.

It will be appreciated that the above embodiments of this invention are merely illustrative, and not limiting. There are many types of devices that can be constructed in accordance with the principle of this invention. Further, the particular construction disclosed for any such device is not an essential feature of this invention but again illustrative of the manner of fabricating devices to make use of this principle.

I claim:

1. A cushioning device comprising:

a load bearing envelope containing fluid, a fluid supply reservoir, a fluid exhaust reservoir, a pressure relief valve in fluid communication with said envelope and said fluid exhaust reservoir to release fluid from said envelope to said exhaust reservoir when pressure in the envelope exceeds a predetermined relief pressure, and a self-opening intake valve in fluid communication with said envelope and said fluid supply reservoir, said intake valve being adapted to independently open itself when fluid pressure within the envelope is less than pressure in the fluid supply reservoir and permit fluid to re-enter the envelope from the supply reservoir, wherein the envelope deforms under the application of a load and reforms upon removal of said load thereby reducing the pressure within the envelope to a preselected level causing said self-opening intake valve to independently open itself and permit fluid to re-enter the envelope from the supply reservoir.

2. The cushioning device of claim 1 in which the envelope contains resilient material to resist the application of a load and to reform the envelope as a load is lifted from said envelope.

3. The cushioning device of claim 2 in which the fluid supply reservoir is unpressurized.

4. The cushioning device of claim 3 in which the envelope is fitted closely about the resilient material and said resilient material is porous to the passage of said fluid.

5. The cushioning device of claims 1, 2 or 3 in which the pressure relief valve means has a pressure regulator means to permit control of the said predetermined relief pressure.

6. The cushioning device of claim 4 in which the pressure relief valve means has a pressure regulator means to permit control of the said predetermined relief pressure.

7. The cushioning device of claim 1 in which the fluid supply reservoir and the fluid exhaust reservoir are set at predetermined pressures to facilitate control of the pressure within the envelope.

8. A cushioning device comprising:

a plurality of load bearing envelopes containing a fluid, an unpressurized fluid supply reservoir, and a fluid exhaust reservoir, in which one or more of said envelopes has:

a pressure relief valve means in communication with said envelope and said fluid exhaust reservoir to release fluid from said envelope to said exhaust reservoir when pressure in the envelope exceeds a predetermined relief pressure, a self-opening intake valve adapted to independently open when fluid pressure within the envelope is less than pressure in the fluid supply reservoir and permit fluid to re-enter the envelope from the supply reservoir, wherein each envelope deforms under the application of a load to provide a predetermined relief pressure and reforms upon removal of said load.

9. The cushioning device of claim 8 in which each envelope contains resilient material to resist the application of a load and to reform the envelope as a load is lifted from said envelope.

10. The cushioning device of claim 9 in which the resilient material is shaped to increase the support of the load as the load sinks into the envelope.

11. The cushioning device of claim 10 in which the envelope is fitted closely about the resilient material and said resilient material is porous to the passage of said fluid.

12. The cushioning device of claims 8, 9 or 10 in which each envelope has a pressure relief valve and a pressure regulator means to permit control of the predetermined relief pressure of each envelope.

13. The cushioning device of claim 11 in which each envelope has a pressure relief valve and a pressure regulator means to permit control of the predetermined relief pressure of each envelope.

14. The cushioning device of claim 8 in which the fluid supply reservoir and the fluid exhaust reservoir are set at predetermined pressures to facilitate control of the pressure within the envelopes.

15. The cushioning device of claim 8 in which the fluid is air and the ambient environment is the fluid supply reservoir and the fluid exhaust reservoir.

16. The cushioning device of claims 8, 9 or 10 in which said plurality of envelopes are laid in parallel juxtaposition to form a mattress element.

17. The cushioning device of claim 11 in which said plurality of envelopes are laid in parallel juxtaposition to form a mattress element.

18. The cushioning device of claims 8, 9 or 10 in which said plurality of envelopes are combined in to form a seat.

19. The cushioning device of claim 12, in which said plurality of envelopes are laid in parallel juxtaposition to form a mattress element.

20. The cushioning device of claim 13, in which said plurality of envelopes are laid in parallel juxtaposition to form a mattress element.

21. A method of cushioning a load, comprising:

providing an envelope containing a fluid and a resilient material, said envelope being in fluid communication with a fluid exhaust reservoir via a pressure relief valve and in fluid communication with a fluid supply reservoir via an intake valve;

applying a load to said envelope wherein application of the load deforms the envelope thereby increasing the air pressure within said envelope and causing a pressure relief valve to independently open itself when the pressure within said envelope exceeds a predetermined relief pressure;

removing at least a portion of said load upon said envelope and at least partially reforming the envelope thereby causing a self-opening intake valve to independently open itself when the air pressure within the envelope falls below the pressure of the fluid supply reservoir and draw fluid into said envelope wherein the respective pressures substantially equilibrate.

22. The method of claim 21 in which the resilient material resists the application of a load and reforms the envelope as a load is lifted from said envelope.

23. The method of claim 22 in which the resilient material increases the support of the load as the load sinks into the envelope.

24. The method of claim 22 in which the pressure relief valve has a pressure regulator means and further comprising altering the predetermined relief pressure.

25. The method of claim 21 further comprising setting the fluid supply reservoir and the fluid exhaust reservoir at predetermined pressures to facilitate control of the pressure within the envelope.

26. The method of claim 21 wherein said load upon said envelope is fully removed and said envelope fully reforms.

27. The method of claim 22 wherein said intake valve independently closes when the pressure within said envelope and the pressure within said fluid supply reservoir equilibrate.

* * * * *